US008928187B2

(12) United States Patent
Hamm et al.

(10) Patent No.: US 8,928,187 B2
(45) Date of Patent: Jan. 6, 2015

(54) OPERATING CONTROL DEVICE AND OPERATING METHOD

(75) Inventors: Wolfgang Alfred Hamm, Bretten (DE); Martin Baier, Ettlingen (DE)

(73) Assignee: E.G.O. Elektro-Gerätebau GmbH, Oberderdingen (DE)

( * ) Notice: Subject to any disclaimer, the term of this patent is extended or adjusted under 35 U.S.C. 154(b) by 601 days.

(21) Appl. No.: 13/205,230

(22) Filed: Aug. 8, 2011

(65) Prior Publication Data

US 2012/0042745 A1 Feb. 23, 2012

(30) Foreign Application Priority Data

Aug. 17, 2010 (DE) ..... 10 2010 039 415

(51) Int. Cl.

| | |
|---|---|
| ***H01H 83/00*** | (2006.01) |
| ***H01H 25/06*** | (2006.01) |
| ***H01H 19/03*** | (2006.01) |
| *H01H 19/00* | (2006.01) |
| *H01H 19/20* | (2006.01) |

(52) U.S. Cl.

CPC ..... *H01H 25/06* (2013.01); *H01H 19/03* (2013.01); *H01H 19/005* (2013.01); *H01H 19/20* (2013.01)

USPC ..... 307/116; 307/104; 307/80; 307/66; 307/86; 307/64; 345/184; 219/482; 74/473.12; 74/473.3

(58) Field of Classification Search

USPC ..... 307/116, 104, 114, 110; 219/482, 480; 126/39 R; 200/308, 336

See application file for complete search history.

(56) References Cited

U.S. PATENT DOCUMENTS

| | | | | |
|---|---|---|---|---|
| 4,713,502 | A | 12/1987 | Essig et al. | |
| 4,724,287 | A | 2/1988 | Heng et al. | |
| 7,642,673 | B2 * | 1/2010 | Baier | 307/104 |
| 7,642,886 | B2 | 1/2010 | Boss | |

(Continued)

FOREIGN PATENT DOCUMENTS

| | | | |
|---|---|---|---|
| CN | 1489166 | A | 4/2004 |
| CN | 1937127 | A | 3/2007 |

(Continued)

OTHER PUBLICATIONS

European Search Report dated Dec. 12, 2011 in application No. EP 11 17 7591.

Chinese Official Action and Search Report dated Sep. 22, 2014 in Chinese Application No. 201110235748.6.

*Primary Examiner* — Jared Fureman
*Assistant Examiner* — Jagdeep Dhillon
(74) *Attorney, Agent, or Firm* — Lee & Hayes, PLLC

(57) ABSTRACT

An operating control device for adjusting the power of a heating device has a rotary knob that has an off position in which said rotary knob is deactivated, and a working position into which said knob can be brought to adjust the power. The working position is predetermined by a lock-in position, and the rotary knob can be rotated over a working angle of a rotation range in at least one direction of rotation from the working position counter to a counterforce that rises as the angle of rotation increases. The operating control device can detect the angle of rotation and uses a control system of the operating control device for adjusting the power. The control system is configured in such a manner that the power is adjusted more rapidly as the angle of rotation increases.

20 Claims, 5 Drawing Sheets

(56) References Cited

U.S. PATENT DOCUMENTS

| | | | | |
|---|---|---|---|---|
| 2003/0141175 | A1* | 7/2003 | Spiegel et al. | 200/336 |
| 2005/0072910 | A1 | 4/2005 | Hayashi | |
| 2007/0062790 | A1 | 3/2007 | Lee | |
| 2008/0202906 | A1* | 8/2008 | Schelbert et al. | 200/308 |
| 2009/0000413 | A1* | 1/2009 | Furhoff et al. | 74/473.3 |
| 2010/0012647 | A1* | 1/2010 | Baier et al. | 219/482 |
| 2010/0089386 | A1* | 4/2010 | Albizuri | 126/39 R |

FOREIGN PATENT DOCUMENTS

| | | |
|---|---|---|
| CN | 101382817 A | 3/2009 |
| DE | 10 84 811 | 7/1960 |
| DE | 72 03 112 | 4/1972 |
| DE | 2105638 A1 | 8/1972 |

* cited by examiner

OPERATING CONTROL DEVICE AND OPERATING METHOD

RELATED APPLICATIONS

This application claims priority to German patent 10 2010 039 415.7 filed on Aug. 17, 2010, the contents of which are incorporated by reference.

FIELD OF USE

The present disclosure relates to an operating control device for the functional adjustment of a heating device, in particular for adjusting the power, wherein said operating control device has a rotary knob with an OFF position and a working position. The disclosure furthermore relates to an operating method for an operating control device of this type.

BACKGROUND

It is known, for example, from DE-A-2105638 to form a rotary knob having a plurality of rotational positions in order to adjust the power of a heating device. The power is adjusted merely by means of rotation.

It is also known from U.S. Pat. No. 4,713,502 that a corresponding operating control device with a rotary knob in an OFF position cannot be rotated. From the OFF position, the rotary knob has to be pulled out or pushed in order to be brought into a working position in which it can then be rotated for adjusting the power of a heating device. Solutions of this type, in particular if the rotary knob first of all has to be pressed in so as to be subsequently actuated, have in the meantime become widespread in use. In said working position, a large range of rotation, for example 270°, can then be provided. The range of rotation can be divided into several steps or power levels, or, in the case of an oven selector switch, also into different functions. The angle of rotation range is brought about by a certain angular range around the zero position being omitted from a full circle angle since the rotary knob here can be brought from the working position into the off position and vice versa.

SUMMARY

One embodiment of the invention addresses the problem of providing an operating control device of the type mentioned at the beginning and a corresponding operating method, with which prior art problems can be solved and, in particular, the possibility is provided that an operating control device can be operated in a novel manner.

This problem is solved by an operating control device having the features and operating methods as claimed herein. Advantageous and preferred refinements of the invention are the subject matter of the further claims and will be explained in more detail below. Some of the features mentioned below are described only for the operating control device or only for the operating method. However, they are intended to be applicable independently thereof both for the operating control device and for the operating method. The wording of the claims is incorporated in the description by express reference.

Provision is made for the rotary knob to be deactivated or not to be able to be rotated at all in an OFF position. It can be brought from said OFF position into a working position in order to carry out a functional adjustment of the heating device, in particular to change the power thereof. According to one embodiment of the invention, the working position is predetermined by a lock-in position or the like, i.e. by a mechanical device which automatically adjusts the working position and attempts to rotate the rotary knob back into said working position. In this embodiment, the working position is advantageously a stable intermediate position. The rotary knob can be rotated over a working angle of rotation range in at least one direction of rotation from said working position, specifically counter to a counterforce which rises as the angle of rotation increases. Furthermore, the operating control device has an angle detecting means for detecting the angle of rotation. The angle detecting means is connected to a control system of the operating control device for the functional adjustment. The control system here is advantageously configured in such a manner that, as the angle of rotation becomes larger, the functional adjustment, in particular the adjustment of the power of the heating device, is carried out more rapidly or changes more rapidly. The effect that can thereby be achieved with the operating method is that, firstly, a type of zero position is provided in the working position and, starting from the latter, rotation at least in one direction of rotation, and, advantageously, also in the other direction of rotation, in each case brings about an adjustment of the function. This is preferably an increase of power in one direction and a reduction of power in the other direction of rotation. By means of the division into the off position and the working position, a lock can be achieved against unauthorized actuation, in particular in the form of a child-proof lock.

It should be noted that, in alternative refinements of the invention, as a modification, it is also possible to dispense with the OFF position, and the latter is consequently merely optional. If, for example, a child-proof lock is not desired, the working position can form the single position or basic position for the rotary knob of the operating control device.

By means of a possible dependency of the rapidity of the change of the functional adjustment or adjustment of the power on the angle of rotation, it is possible to keep the range of the working angle of rotation relatively small. In an advantageous manner, from the working position, the range can be less than 45°, particularly advantageously between 10° and 30°. Furthermore, provision is made here for the control system not to adjust or change the function of the heating device exclusively depending on the angle of rotation, but rather takes into consideration how long and for what time a certain angle of rotation is adjusted or held, with the time component being taken into consideration at the same time. The size of the angle of rotation here is advantageously directly correlated with the size of the speed of change such that, given a larger angle of rotation, a more rapid functional adjustment arises than at a smaller angle of rotation. It is firstly possible here for an acceleration of the functional adjustment to take place approximately linearly with an increasing angle of rotation. Secondly, said acceleration may even be super-proportional for a particularly rapid functional adjustment or adjustment of the power at a relatively large angle of rotation.

Instead of the dependency of the rapidity of the change of the functional adjustment or adjustment of the power on the angle of rotation, provision can be made, by means of a repeated rotational movement with a very small angle of rotation in the same direction, for the functional adjustment to be carried out, such as increasing or reducing the adjustment of the power. This is advantageously carried out from an unstable intermediate position of the operating control device. As an alternative, it may also be carried out from the working position. In particular, the small angle of rotation is approximately 3° to 15°. In a further embodiment of the invention, it may be limited by a rotational stop that may also be overcome if a certain rotational force is exceeded. It is possible, for example, for the power to be increased or reduced by a level with each small rotational movement. This is also referred to as toggling and is a tried-and-tested, simple, and intuitively comprehensible method for functional adjustment or adjustment of the power.

In a further advantageous refinement of the invention, provision is made for the rotary knob to be able to be rotated from the working position in the directions of rotation thereof counter to a counterforce in each case. In this case, the counterforce advantageously formed in such a manner that it is approximately identical in size in both directions of rotation and is correlated in an identical manner with the angle of rotation. However, it may also be larger in one direction of rotation than in the other, for example it may be larger in the event of an increase in power than in the event of a reduction in power.

Small working angle of rotation ranges have the advantage that a relatively small hand movement suffices for the operation. Said movement then has to be maintained for a longer time until, as it were, by automatic passing through or running up or running down through a plurality of power levels, a desired adjustment has been carried out.

In a further embodiment of the invention, a counterforce device for the counterforce can be configured according to the cam principle or can have a cam of this type. For this purpose, it can have an inwardly protruding cam part which runs in the radial direction and, at least within the working angle of rotation range, bears against a slotted sliding link for the cam part. Said slotted sliding link extends from the working position in the direction of the latching part and laterally away therefrom, i.e., is advantageously curved. In this case, the cam part is configured in a manner such that it can be pressed in in the radial direction counter to a cam spring in order to yield depending on the shape of the slotted sliding link. By means of the slotted sliding link, this movement of the cam part against a cam spring has the effect that both the rotation of the rotary knob per se and the maintaining of the angle of rotation require a certain force. This force is desirable as feedback on the operation. In this case, provision is advantageously made for the cam part to be rotationally fixed, i.e., not to rotate, but rather to be able to be moved only in the radial direction towards a slotted sliding link on the rotary knob.

As an alternative, the cam part may also protrude outwards in the radial direction and bear against the inside of a slotted sliding link that then has an outward bulge for the cam part. The cam part is then provided on the rotor. As yet another alternative to a cam part in the radial direction, i.e., as it were, on the outer edge of a rotor or of a disk, provision may also be made for a cam to bear against an upper side or lower side of the rotor. The slotted sliding link is then also provided here, which does not constitute a problem.

The slotted sliding link is particularly advantageously of symmetrical design with respect to a line along the radial direction of the cam part towards the axis of rotation such that a counterforce is formed identically, independently of the direction of rotation. However, it is readily also conceivable here to design the counterforce to be greater in the one direction than in the other, as mentioned above. This is also applicable for the abovementioned alternative on the upper side or lower side of the rotor.

As an alternative to a counterforce device with a cam part and slotted sliding link, a tension or compression spring can be provided for generating the counterforce. As the angle of rotation increases from the working position, said spring can be subjected to increasing force such that the counterforce then likewise rises. One possible desired non-linear rising of the counterforce can be achieved with the spring force not necessarily running in a direction perpendicular to the radial direction, for example by a spring running towards the axis of rotation of the rotary knob or away from the axis of rotation, as is easily conceivable to a person skilled in the art. A degressive or progressive change of the spring force can thus be achieved.

For an operation that is suitable in practice and is nevertheless readily identifiable haptically, a counterforce can be in the region of 0.1 Newton centimetre ("Ncm") to a few Ncm, for example at around 1 Ncm. This produces a clearly noticeable counterforce which at the same time can be overcome during operation without significant problems.

In another embodiment of the invention, a magnet and two magnetic sensors can be provided for detection of a rotation of the rotary knob according to the magnetic principle. In this case, in an advantageous manner, the magnet is of rotatable design, and in particular is fastened to the rotary knob, while the two magnetic field sensors are fixed in position. As a result, inter alia, the activation of the magnetic field sensors is easier, which may be in particular Hall sensors.

In order to pass from the previously described off position into the working position, provision may be made for the operating control device or the rotary knob to have to be pressed in. In the pressed-in state, the rotary knob then has to be rotated somewhat in order, as it were, to remain in the working position. Alternatively, provision may be made for the working position to be maintained after the rotary knob has been pressed in or for the latter not to be squeezed out again. The rotary knob only comes out again by renewed pushing thereon and thus passes automatically into the off position. Latching solutions of this type are also known to a person skilled in the art, for example by what are referred to as retractable knobs.

The movement from the off position into the working position can be identified by a magnet being embedded in the end side of the spindle. The magnet is faced, on the operating control device, by a magnetic field sensor which identifies the previously described approach when the rotary knob is pushed in and thus switches on a control system or the like as a sign that actuation is taking place right away.

These and further features emerge not only from the claims but also from the description and the drawings, wherein the individual features can be realized in each case by themselves or as a plurality in the form of subcombinations in an embodiment of the invention and in other fields and can constitute advantageous and inherently protectable embodiments for which protection is claimed here. The subdivision of the application into individual sections and sub-headings does not restrict the general validity of the statements made thereunder.

BRIEF DESCRIPTION OF THE DRAWINGS

Exemplary embodiments of the invention are illustrated schematically in the drawings and are explained in greater detail below. In the drawings:

FIG. 2 shows a sectional illustration similar to FIG. 1 in the working position, after being pushed in.

DETAILED DESCRIPTION

Figure 1:
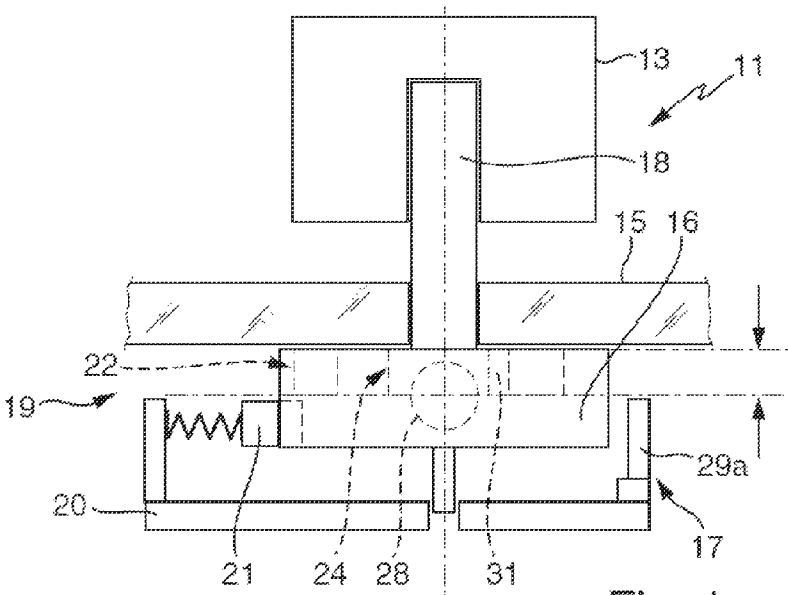
FIG. 1 shows a sectional illustration through a first operating control device according to an embodiment the invention in the OFF position.

In the lateral section in FIG. 1, an operating control device 11 according an embodiment of the invention is illustrated, with a rotary knob 13 in front of an operating control panel 15 of the operating control device 11. The rotary knob 13 is configured for activating a sensor arrangement 17 and, for this purpose, sits on a rotary spindle 18 which passes through the operating control panel 15 and which has a rotor 16 which is mounted in a counterforce device 19 or can rotate counter to the latter.

The counterforce device 19 has a stationary supporting plate 20 which is mounted, for example, on the rear side of the operating control panel 15. The supporting plate 20 has a latching part of cam-like design or a cam part 21 which can also be seen in the top view from FIG. 3 where it is explained in greater detail. Furthermore, the counterforce device 19 has a latching opening 22 which can likewise be seen better from FIG. 3, specifically at the outer circumferential edge.

Figure 3:
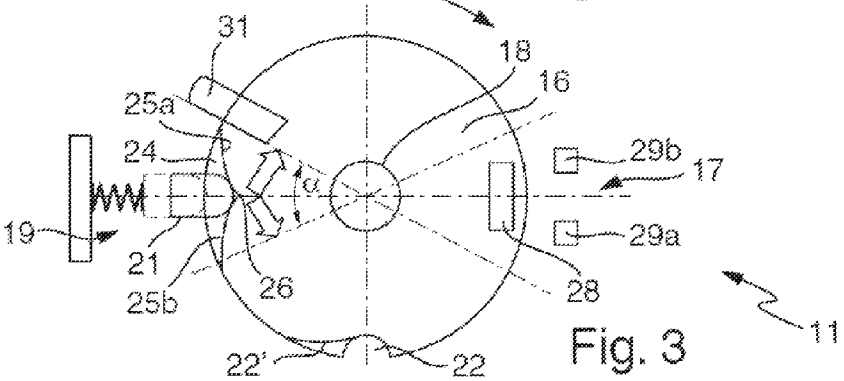
FIG. 3 shows functional illustration of a top view of the operating control device according to FIGS. 1 and 2.

The above mentioned sensor arrangement 17 in the form of two magnetic sensors 29*a* and 29*b*, the arrangement and position of which relative to each other can also be seen again in FIG. 3, is fastened to the supporting plate 20. A magnet 28 is also arranged in the counterforce device 19, which may be configured in the form of a thick disk, said magnet moving together with the rotation of the counterforce device 19 in a manner corresponding to the rotary knob 13.

Figure 2:
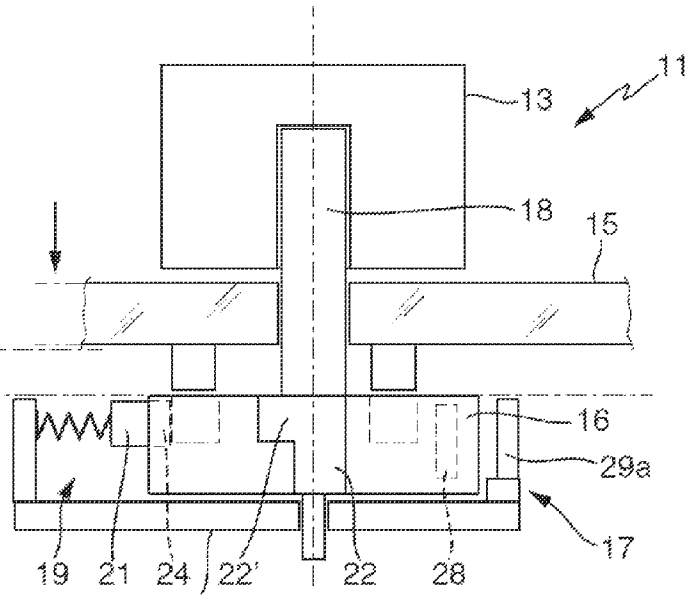

In FIG. 1, a relatively large distance is provided between the lower side of the counterforce device 19 and the upper side of the supporting plate 20. As FIG. 2 shows, this distance serves, upon pushing on the rotary knob 13 via the rotary spindle 18, to press the counterforce device 19 onto the supporting plate 20, said counterforce device under some circumstances bearing against said supporting plate. For better explanation, reference is made here at the same time to FIG. 3. The pushing on the rotary knob 13 is namely only possible in the position illustrated in FIG. 1 if the latching opening 22, which points downwards in FIG. 3, fits precisely on the latching part 21. This is because only then can the counterforce device 19 be pushed in and pushed onto the supporting plate 20 in order to reach the state illustrated in FIG. 2.

That is to say, therefore, FIG. 1 illustrates the OFF position and FIGS. 2 and 3 illustrate the working position. In the top view of the counterforce device 19 according to FIG. 3, it can be seen that the latching opening 22 has, to the left, a bevel 22' which fades out gently onto the diameter of the counterforce device 19. Whereas, therefore, according to FIG. 1, the latching part 21 which is of cam-like design rests in the latching opening 22, in the working position according to FIG. 3 said latching part has been pushed in and rotated through 90° counterclockwise. In this case, the latching part 21 then lies in the slotted sliding link 24, as illustrated.

The slotted sliding link 24 has slotted link cheeks 25*a* and 25*b*, which fade out obliquely upwards and downwards, on both sides from a central depression 26. The angular range a formed by the extent of the slotted link cheeks 25*a* and 25*b* is approximately 60°, but may be larger or smaller. It can be seen that the latching part 21, which is loaded to the left by a latching spring and is therefore pushed onto the center point of the counterforce device 19, lies against the slotted link cheeks 25*a* and 25*b* in the slotted sliding link 24 in such a manner that the position according to FIG. 3 automatically arises. When the counterforce device 19 is rotated by means of the rotary knob 13 and rotary spindle 18, the latching part 21 is pushed to the left against the spring by the slotted link cheeks 25*a* or 25*b*, which makes the rotational movement more difficult and brings about resetting into the zero position illustrated in FIG. 3. At the same time, each rotation, even through small angles and in which the magnet 28 co-rotates, can be identified by means of the magnetic sensors 29*a* and 29*b* which, relative to each other, detect the signal released by the magnet 28. By means of the configuration of the slotted link cheeks 25*a* and 25*b* and the slope thereof, the counterforce which rises as the angle of rotation increases from the zero position and which acts on the rotary knob 13 can be adjusted, also, of course, in interaction with the strength of the spring behind the latching part 21. If the sliding movement of the latching part 21 on the slotted sliding link 24 has little friction, which is possible by means of corresponding plastics materials and greases, the rotary knob 13 will only need to be rotated counter to the counterforce.

The angle of rotation range is delimited upwards above the slotted link cheek 25*a* by a protruding stop 31. This therefore means that overrotation is not possible in this direction. Overrotation in the other direction, i.e., beyond the slotted link cheek 25*b*, has the consequence, after somewhat further rotation, that the latching opening 22 comes again to lie over the latching part 21 and then the counterforce device 19 is pushed away again from the supporting plate 20 into the position according to FIG. 1 by springs (not illustrated) or the like.

Instead of the counterforce device 19 illustrated here with the latching part 21 and slotted sliding link 24, the arrangement of a plurality of springs is also conceivable, specifically compression or tension springs, counter to which, for example, the stop 31 acts from a zero position. It would even be possible here to use a single spring if the latter has an approximately identical deployment of force both in terms of compression and in terms of tension. With a different deployment of force, it is also possible for the abovementioned different counterforce, which may be different depending on the direction of rotation, to be achieved.

It can be seen from FIG. 3 that, as the counterforce device 19 increasingly rotates out of the zero position illustrated, the force necessary for the rotation rises, specifically super-proportionally. This can be connected, for example by an adjustment of power, to the operating control device 11 for a heating device, for example for a gas hob. The longer, for example, a deflection from the zero position is maintained with the latching part 21 pushed in, the longer is a power level changed upwards or downwards. The further the rotation, i.e., the greater the angle of rotation, the more the changing speed rises. It is therefore possible with relatively little rotational force for a slow adjustment of power or for counting off of power levels to be carried out. A highly precise adjustment is thus possible. As an alternative, by stronger or else further rotation of the rotary knob 13 with a greater angle of rotation from the zero position counter to greater counterforce, said adjustment of the power or counting off of the power levels can be carried out considerably quicker. This is favorable especially if a high power level is desired and is intended to be set, in particular if it is to be set rapidly.

The operating control device 11 illustrated also has the safety function that signals regarding the rotational position are only produced at the magnetic sensors 29*a* and 29*b* when the magnet 28 is opposite said magnetic sensors. If the latching part 21 leaves the slotted sliding link 24 because of being pushed up, for example, by spring force, the magnet 28 is moved away from the magnetic sensors 29*a* and 29*b* in such a manner that the latter only respond weakly, if at all. The operating control device 11 can also identify this as switching off.

As has been discussed above, the latching part 21 and the slotted sliding link 24 may be, as it were, inverted or rotated from the inside to the outside. The slotted sliding link is then stationary and surrounds the rotor which has the outwardly pointing latching part. A bulge outwards would then correspond to the central depression 26 inwards.

Figure 4:
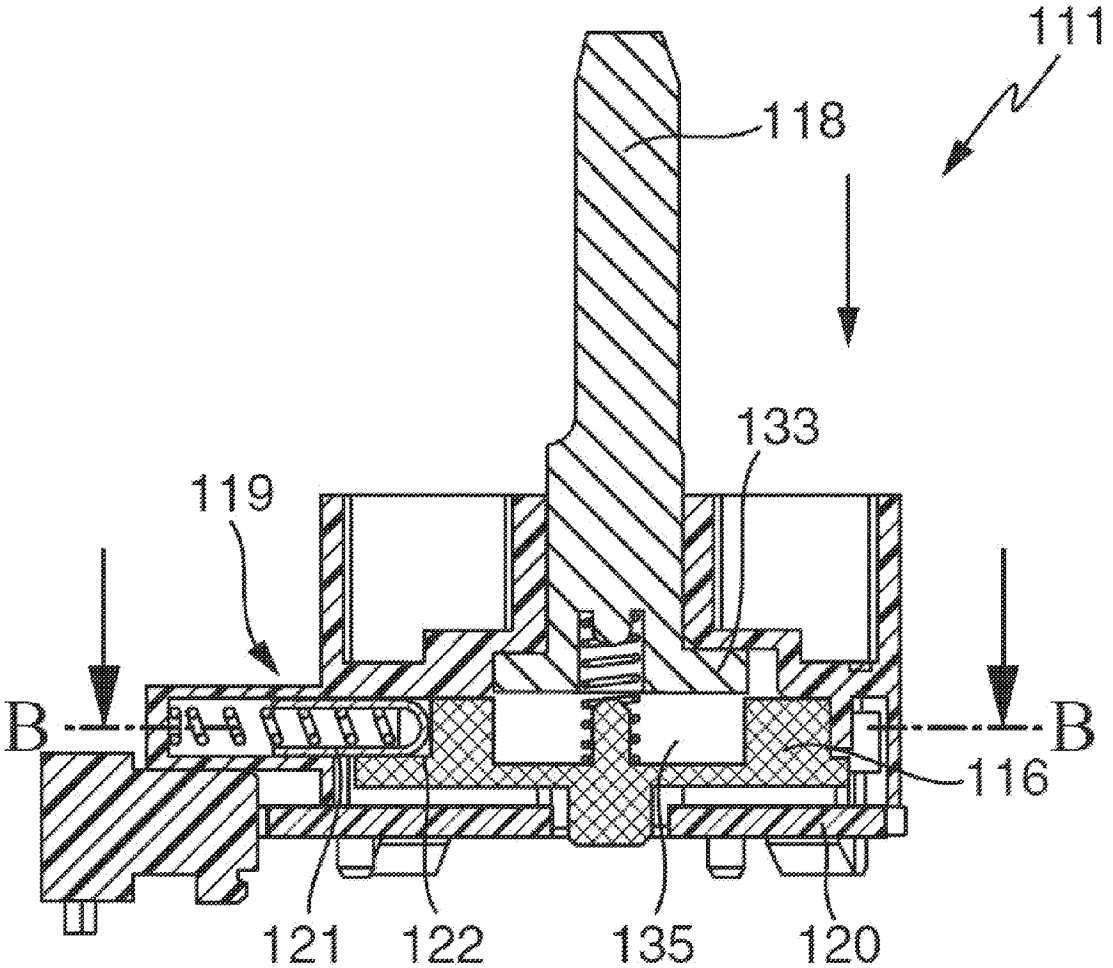
FIG. 4 shows a sectional illustration similar to FIG. 1 through a second operating control device according to an embodiment the invention in the OFF position.

FIG. 4 illustrates, in a section similar to FIG. 1, a further operating control device 111 in a less functional, but more specific illustration. The operating control device 111 has a rotary spindle 118 which can be pushed into a rotary spindle disk 133 counter to a spring force so as to be coupled and subsequently rotated. In this case, the rotary spindle 118 is released from the slotted latching link in the housing 120. The design of said rotary spindle disk 133 can also be seen from the sectional illustration according to the section B-B from FIG. 5 and is explained in greater detail below.

A rotor 116 similar to that described previously is located below the rotary spindle 118 and the rotary spindle disk 133, the rotary spindle disk 133 and rotor 116 not necessary being operatively connected or connected to each other. The rotor has a central chamber 135 in which the rotary spindle disk 133 can engage when the rotary spindle 118 is pushed. For a torque-transmitting connection and for a special matching shape only in a single position, the projections 134*a* and 134*b*, which can be seen in FIG. 5 and which project into the chamber 135, are provided on the rotor 116. The rotary spindle disk 133 has corresponding recesses in which the projections 134*a* and 134*b* engage in the appropriate position. The rotary spindle 118 is then operatively connected to the rotor 116 and can rotate the latter.

A counterforce device 119 which acts from the outside is in turn provided on the rotor 116, with a latching part 121 which is pressed into a latching opening 122 in the rotor 116 by a helical spring. Furthermore, the rotor has, at the latching opening 122, a slope 122' against which the latching part 121 bears upon rotation counterclockwise to the left and is pressed outwards. After an angle of rotation of approximately 90°, the latching part 121 comes to engage in the one slotted sliding link 124. The slotted sliding link 124 has two slotted link cheeks 125*a* and 125*b* and a depression 126. Flattened stop portions 127*a* and 127*b* can be seen on the outer regions of the slotted link cheeks 125*a* and 125*b*, said flattened stop portions, upon rotation such that the latching part 121 bears against them, imparting a type of latching sensation to the user or a type of exact, but unstable intermediate position that can nevertheless be rotated further in both directions. The effect can also be achieved by reaching the right flatted stop portion 127*a*, such that the latching part 121 slides back into the stable intermediate position in the center of the slotted sliding links 125*a* and 125*b*.

A magnet 128*a* which, together with two magnetic sensors 129*a* and 129*b*, forms a sensor arrangement 117 is again fitted in the rotor 116. Since the magnet 128*a* lies precisely opposite the slotted sliding link 124 together with the depression 126, at an angle of rotation of 90° said magnet is precisely between the two magnetic sensors 129*a* and 129*b*. If, as previously described, the rotor 116 is then rotated by means of the engaging rotary spindle disk 133 and the rotary disk 118 for a distance to the left or a distance to the right, preferably until the latching part 121 bears against the flattened stop portions 127*a* and 127*b*, the magnet 128*a* is directly in front of the one or other magnetic sensor 129. As a result, said positions can be used for signal identification and evaluation as described at the beginning.

Figure 5:
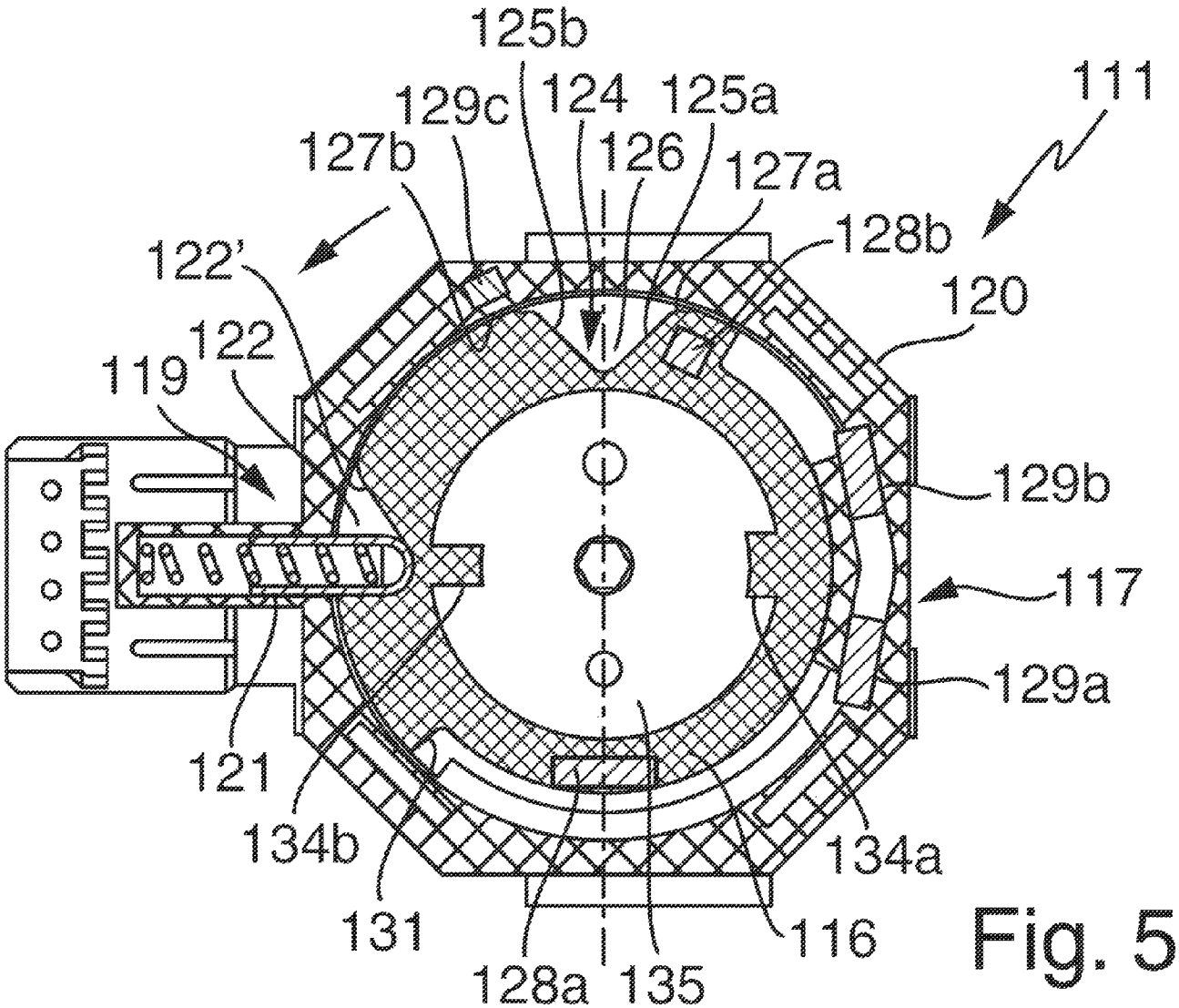
FIG. 5 shows a sectional illustration according to B-B from FIG. 4, and FIGS. 6-9 show functional diagrams of the outer contour of the rotating rotor corresponding to FIG. 5 and to a further embodiment.

Furthermore, provision may be made for the magnet 128*a*, upon rotation of the rotor disk 116 to the left from the position according to FIG. 5, to first of all pass the lower magnetic sensor 129*a*. This can be identified as a "wake-up region" and, for example, can switch on a control system which up to then was in a type of standby mode and providing a minimal supply of power. A further function could be, for example, when activating a gas stove with an electronic control system, the ignition at a gas burner, the power of which is then adjusted in power levels. It is thus ensured in all cases that the igniting device is activated when a gas valve is opened by the subsequent adjustment.

As an alternative identification, for example for ignition using a gas burner, a further magnet 128*b* and a further magnetic sensor 129*c* can be provided. Said magnet and sensor are rotated through an angle of rotation of approximately 45°, as can be seen from FIG. 5. After an angle of rotation of approximately 45°, the magnetic sensor 129*c* identifies said rotation and can ignite a gas burner at the same time as, after the angle of rotation of approximately 90°, the power for the gas burner can be adjusted. The angle of rotation of approximately 45° is then a "wake-up region". The magnet 128*b* here is arranged in such a manner than it cannot interfere with the magnetic sensors 129*a* and 129*b*.

If increased safety conditions are required at said wake-up region, a further sensor, for example a magnetic field contact or a Reed switch, can be provided. These interact with a corresponding magnet.

The direction of rotation in FIGS. 4 and 5 could also be the other way around by a correspondingly reflected design, i.e., around to the right.

Figure 6:
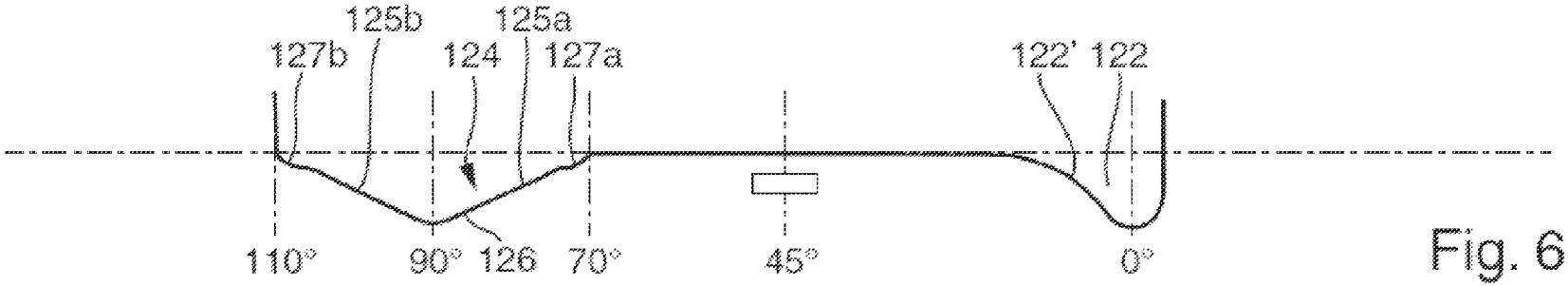

FIG. 6 illustrates schematically a type of functional diagram the profile which the rotor disk 116 has over the course of an angle of rotation. At the position 0°, which corresponds to the illustration in FIG. 5, the latching opening 122 is provided. As the angle of rotation increases, the above-described wake-up region arrives first of all, at 45°, when namely the magnetic sensor 129*a* registers the magnet 128*a* in the position in front of it. At approximately 70°, the slotted sliding link 124 of the depression 126, which, in turn, is located precisely at 90°, begins with a flattened stop portion 127*b*. The other flattened stop portion 127*a* is located at approximately 110°.

Starting from said angular position of approximately 110°, the rotor disk 116 can be rotated even further to the left, but this, however, does not show any effect, since the magnet 128*a* is also located outside the magnetic sensors 129*a* and 129*b*. A stop may also be provided.

Figure 7:
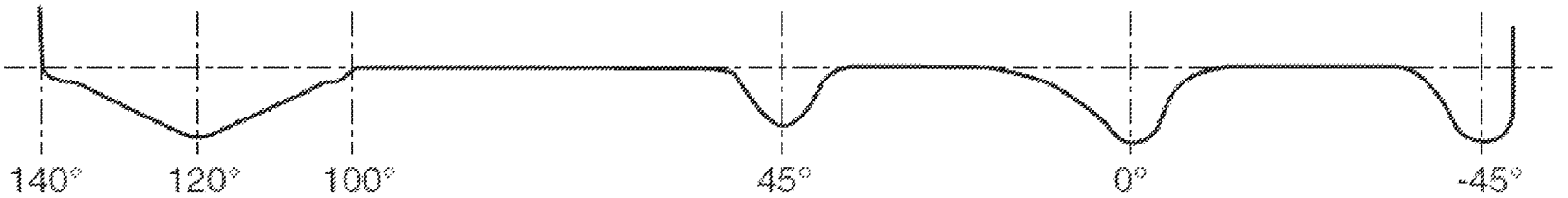

In a further embodiment of a functional diagram according to FIG. 7 involving a modification of the rotor disk 116, it can be seen that a zero position is again provided in the position 0°. However, starting therefrom, unlike according to FIGS. 4 to 6, the rotor disk 116 can also be rotated to the right, specifically by up to approximately 45°. A stop with a corresponding latching opening, beyond which rotation is not possible, is then again provided there. Said rotational position at minus 45° could be identified, for example, by a further magnet which would be arranged in a rotor. In this case, it would be arranged, looking by way of example at the rotor 116 according to FIG. 5, approximately between the slotted sliding link 124 and the upper magnetic sensor 129*b* such that, as the rotor 116 is rotated to the right, said magnet can approach the magnetic sensor 129*b* and lie opposite the latter, which can then be correspondingly identified.

Furthermore, in the illustration in FIG. 7, at an angle of 45°, not only is a previously described wake-up function provided but, by means of a further depression in the outer side of a rotor, so too is a special function that can be sensed mechanically. The latter can be moved arbitrarily, for example a cooking operation at fixed power or the like.

Similar to FIGS. 4 to 6, a slotted sliding link with two slotted link cheeks and flattened stop portions on the outside is provided at the position of approximately 120°. The rotor therefore has to be rotated through for a small distance further than in the embodiment according to FIG. 6.

Figure 8:
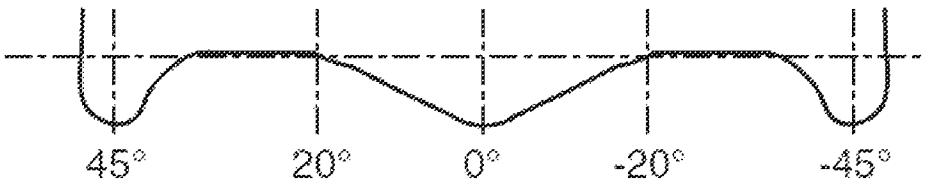

Further modifications are possible and are easily conceivable with reference to FIGS. 6 and 7. For example, at an angle of greater than 90°, in a modification of FIG. 6, a further stop could be realized by a latching opening in order to prevent further rotation, it then being possible to assign a special function to a stop of this type. This then corresponds to the stop at 0°, simply in a reflected manner. An illustration of this type would then be mirror-symmetrical to the center point, said center point then also being able to be assigned the angle of rotation of 0°. This is illustrated in FIG. 8.

Figure 9:
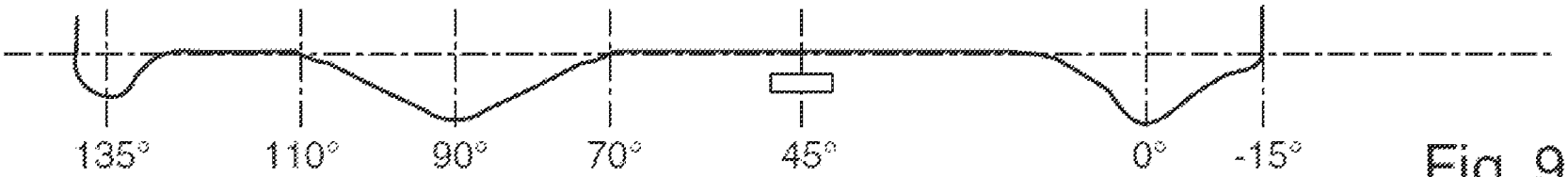

FIG. 9 illustrates another modification of FIG. 6. The stop here has migrated to the left from the position at 0° to a position at approximately 135°. A type of one-sided rocking region is now located at the position 0°. It is formed in the manner of a bisected rocking region with a slotted link cheek to the right as far as the position −15°. An adjustment can be carried out here by rocking or by the abovementioned toggling by means of small rotations or movements to the right. Further to the right thereof, there is then directly a stop against even further rotation.

Furthermore, in the illustration according to FIG. 7, the special function formed by the depression at 45° and the slotted sliding link at 120° could be interchanged. Furthermore, at a location at an angle of somewhat more than 0°, a wake-up region corresponding to FIG. 6 could again also be provided here. There could be the same in the case of FIG. 7.

The invention claimed is:

1. An operating control device for functional adjustment of a heating device comprising a rotary knob, wherein said operating control device is configured such that said rotary knob has an OFF position that deactivates said operating control device, and said rotary knob has a working position for the functional adjustment, wherein said working position is predetermined by a lock-in position, and said rotary knob is rotatable over a working angle of rotation range in at least one direction of rotation from said working position counter to a rotational counterforce that increase as an angle of rotation increases, wherein said operating control device has an angle detecting means for detecting said angle of rotation, said angle detecting means connected to a control system of said operating control device for said functional adjustment, and wherein a rotational counterforce device provides the rotational counterforce and comprises a protruding cam part that runs in a radial direction and, at least within said working angle of rotation range, bears against a slotted sliding link for said cam part, said slotted sliding link extending from said working position towards a latching part and laterally away therefrom, said cam part configured to be pressed in said radial direction counter to a cam spring.

2. The operating control device as claimed in claim 1, wherein said control system is configured such that as said angle of rotation becomes larger, said functional adjustment changes more rapidly.

3. The operating control device as claimed in claim 1, wherein a repeated rotational movement with a small angle of rotation in the same direction carries out the functional adjustment comprising increasing or reducing a power setting.

4. The operating control device as claimed in claim 3, wherein increasing or reducing the power setting originates from an unstable intermediate position of said operating control device.

5. The operating control device as claimed in claim 1, wherein said rotary knob is rotatable from said working position in both directions of rotation counter to the rotational counterforce in each case.

6. The operating control device as claimed in claim 5, wherein the rotational counterforce is the same in both said directions of rotation.

7. The operating control device as claimed in claim 1, wherein said working angle of rotation range from said working position is less than 45°.

8. The operating control device as claimed in claim 1, wherein said cam part is rotationally fixed and movable only in said radial direction towards the slotted sliding link on said rotary knob.

9. The operating control device as claimed in claim 8, wherein said slotted sliding link is formed symmetrically with respect to a line along said radial direction of said cam part towards an axis of rotation.

10. The operating control device as claimed in claim 1, wherein a rotational counterforce device for generating said rotational counterforce has a spring that, as said angle of rotation from said working position increases, is subjected to an increasing force in order to apply a rising rotational counterforce.

11. The operating control device as claimed in claim 1, wherein said rotational counterforce is in the range of 0.1Ncm to 1Ncm.

12. The operating control device as claimed in claim 1, wherein a magnet and two magnetic field sensors are provided for detection of a rotation of said rotary knob.

13. The operating control device as claimed in claim 12, wherein said magnet is configured to be rotatable and said two magnetic field sensors are fixed in position.

14. The operating control device as claimed in claim 1 configured for a push-and-rotate actuation, and said rotary knob can be pushed-in from said OFF position and is rotatable in order to reach said working position only after being pushed in.

15. An operating method for an operating control device comprising a rotary knob wherein said operating control device is configured such that said rotary knob has an OFF position deactivating the operating control, and that said rotary knob can be brought into a working position for functional adjustment, wherein said working position is predetermined by a lock-in position, and said rotary knob is rotatable over a working angle of rotation range in at least one direction of rotation from said working position counter to a rotational counterforce that increase as an angle of rotation increases, and wherein said operating control device has an angle detecting means for detecting said angle of rotation, said angle detecting means connected to a control system of said operating control device for the functional adjustment, said operating method comprising:

rotating the operating control device from an OFF position to a working position;

rotating the operating control device from said working position in an opposite direction of rotation to counter a rotational counterforce provided by a protruding cam part that runs in a radial direction and, at least within said working angle of rotation range, bears against a slotted sliding link for said cam part, said slotted sliding link extending from said working position towards a latching part and laterally away therefrom, said cam part configured to be pressed in said radial direction counter to a cam spring;

detecting said angle of rotation; and adjusting a power setting of an activated heating device associated with said rotary knob.

16. The operating method as claimed in claim 15, wherein said operating control device is initially pressed-in from said OFF position and is then brought or rotated into said working position.

17. The operating method as claimed in claim 15, wherein said control system is configured such that as said angle of rotation becomes larger, said functional adjustment changes more rapidly.

18. The operating method as claimed in claim 15, wherein a repeated rotational movement with a very small angle of rotation in the same direction carries out said functional adjustment comprising increasing or reducing the power setting.

19. The operating method as claimed in claim 15, wherein said functional adjustment is carried out from an unstable intermediate position of said operating control device.

20. The operating method as claimed in claim 19, wherein said small angle of rotation is 3° to 15°.

* * * * *